US006050209A

United States Patent [19]

Vincent et al.

[11] Patent Number: 6,050,209

[45] Date of Patent: Apr. 18, 2000

[54] VANGS

[76] Inventors: Raymond Vincent, 16, Adelaide Gardens, South Benfleet, Essex, United Kingdom, SS7 1LA; Colin George Oxford, 4, Warwick Close, Canvey Island, Essex, United Kingdom, SS8 9YB

[21] Appl. No.: 09/060,440

[22] Filed: Apr. 15, 1998

[30] Foreign Application Priority Data

| | | | |
|---|---|---|---|
| Apr. 23, 1997 | [GB] | United Kingdom | 9708208 |
| Mar. 10, 1998 | [GB] | United Kingdom | 9805071 |

[51] Int. Cl.[7] ..... B63B 15/00

[52] U.S. Cl. ..... 114/98; 114/99; 114/102

[58] Field of Search ..... 114/39.1, 97, 98, 114/99, 102, 103, 104, 105, 108, 109, 111, 112, 215, 223

[56] References Cited

U.S. PATENT DOCUMENTS

| | | | |
|---|---|---|---|
| 4,406,240 | 9/1983 | Andersen | 114/99 |
| 4,630,564 | 12/1986 | Duckman et al. | 114/98 |
| 5,070,802 | 12/1991 | Corlett | 114/98 |
| 5,115,752 | 5/1992 | Mitchell | 114/99 |

*Primary Examiner*—D. Glenn Dayoan

[57] ABSTRACT

A vang for producing a desired tension in the mainsail of a yacht employs, in association with a multi-sheave block and tackle system conferring mechanical advantage, a valve releasable, variable length, pressurized gas spring strut. Operation against a spring pre-load of the control valve of the strut by application of a force thereon, being a force derived by the block and tackle system from manual exertion on said block and tackle system, enables the gas spring strut to be released from the length at which it is currently held locked, by reason of closure of the control valve, for such extension or contraction as may be required to produce a desired force on the main-boom and a consequent tension in the leech of the mainsail. The length of the gas spring strut remains unaffected by closure of the valve following removal of the force on the block and tackle system. The vang incorporates control valve secondary actuation means, the operation of which effects immediate actuation of the control valve, that is to say without the necessity of having to overcome spring pre-load using the multi-sheave block and tackle system. The extension of the gas spring strut to its maximum length liberates the leech of the mainsail from tension with the immediate dumping of the driving force of the wind on the sail as a result of lose of aerodynamic shape in the sail.

8 Claims, 4 Drawing Sheets

VANGS

BACKGROUND OF THE INVENTION

1. Field of the Invention

This invention relates to vangs.

To maintain the leech of the mainsail of a yacht under a tension suited to the current angle of attack of the yacht, the wind speed and direction, and other variables affecting the sailing performance of the yacht, and, in particular, to provide, in the mainsail, an approximation, at all times, to an optimum aerodynamic shape, resort is had, to the action of tensioning force applied to the main-boom by the main-sheet, in conjunction with a topping lift fitted to the vessel. Commonly, in the case of yachts, the main-sheet comprises a multi-sheave block and tackle system.

To enable the tension in the leech of the mainsail to be maintained reasonably constant, even when sailing conditions demand a change of angle, in azimuth, of the main-boom with respect to the fore and aft direction of the vessel, in adjusting to variation in wind strength or direction, or when changing tack, the main-sheet block and tackle system is connected to a principal part, the carriage, of a device referred to as a "traveller", the other principal part of which is a track extending athwartships, across the deck of the yacht, at a position between the main mast and the transom of the vessel.

Whilst the main-sheet block and tackle system is effective in holding the main-boom down under a desired tension at any azimuthal position of the boom within the range permitted by the traveller, in order to achieve azimuthal positions for the main-boom beyond the extremities of the traveller, the main-sheet must be slackened-off. Under the resulting loss of tension in the main-sheet, tension in the main-sail, particularly at the leech thereof, compels the main-boom to swing upwardly, the main-sail departing in shape from a desired relatively flat aerodynamic form to a significantly rounder shape, inferior, from an aerodynamic view-point, from the flatter shape to which tension in the main-sheet contributes.

To counter this, and to enable the main-boom to adopt positions beyond the range of the traveller, it is a common practice to employ what is referred to as a kicking strap, or vang, in the control of the pitch and azimuth angles of the main-boom, with respect to the main-mast.

2. Description of the Prior Art

In its most basic form, the vang of the prior art comprises a multi-sheave block and tackle system, distinct from that of the main-sheet, connected between the main-boom and a relatively fixed part of the vessel, generally the main-mast. As with the block and tackle system of the main-sheet, the block and tackle system of the kicking strap is, invariably, such as to provide a substantial mechanical advantage, 5:1, say, enabling quite large downwardly acting forces to be exerted on the main-boom in response to manual effort applied to the vang block and tackle system. By this means, the leech of the sail may be held adequately taut, the sail being thereby constrained to adopt a satisfactorily relatively flat three-dimensional aerodynamic shape, conducive to good handling of the yacht.

More recently, resort has been had to the employment, as vangs, of gas pressurized spring struts settable to any desired length within a certain range.

The known gas pressurized spring strut vang comprises: a gas pressurized spring device, being a pneumatic or oleo-pneumatic piston and cylinder arrangement the cylinder of which holds a charge of gas, commonly nitrogen, under a high pressure; and, mechanically coupling the piston and cylinder, a multi-sheave block and tackle system offering, as before, a substantial mechanical advantage.

In operation, such a gas pressurized spring strut is suitably pivotally coupled, at one end, to the main-boom and at the other to a part, commonly the main-mast, fixed with respect to the main-boom, and, the tendency of the gas spring device being to expand under the pressure within, the length of the strut is adjusted to the desired length so as to control the tension in the sail, particularly the leech, thereof, by increasing or, as the case may demand, decreasing the length of the multi-sheave block and tackle system by which the piston and cylinder of the strut are coupled.

In order to maintain the length of the block and tackle system at the desired length, the sheet by which the block and tackle system is manually adjusted in length must, the desired length for the strut having been achieved, be secured, as by being trapped in a cleat or other similar device fixed with respect to the hull of the vessel.

It is known, also, to provide a vang constituted as an hydraulically operable, variable length strut, being a strut self-sustaining in length at any desired setting.

Since, for the purpose of contraction, such a strut does not rely on the application of an externally applied manual force, the need for a block and tackle system is avoided.

SUMMARY OF THE INVENTION

As will become apparent from the ensuing description, the vang of the present invention, whilst being constituted as a gas pressurized spring strut, differs from the vang described above in that the strut incorporates a gas pressurized spring device of the kind having not only a piston and cylinder arrangement enclosing a charge of gas under a high pressure but, in addition, a control valve having a spring biassed actuator member operable, on demand, to move, against the spring bias acting thereon, such as to cause the control valve to open, the piston and cylinder arrangement extending telescopically, under the action of the high pressure gas charge therewithin, or to be contracted, under a compressive force applied axially to the piston and cylinder arrangement, to a desired shorter overall length, the magnitude of which is a function of the duration that the control valve is held open under the action of the valve actuator member, and, at removal of such demand, to move automatically to the closed state, under the action on the valve actuator member, of said spring bias, the piston and cylinder arrangement being, upon closure of said valve, secure against relative movement, elongation or contraction, therebetween.

Such a strut is, by virtue of the valve action involved, hereinafter referred to as a "valve releasable, variable length, pressurized gas spring strut". Such struts are sometimes referred to as "blockable pressurized gas spring devices". They have found a wide variety of applications, being employed, for examples, as adjustable length struts for the purpose of varying the geometry of variable geometry bed constructions suited to the needs of invalids and in the variable adjustment of the rake angle of the back rests of motor vehicle seats. For a general appreciation of the constuction and operation of such variable length struts, reference should be made, typically, to UK Patents Nos. 1 163 915; 1 217 263; or 1 314 936, granted to Stabilus, Industrie-und Handels-Gesellschaft mbH.

As with the gas spring strut previously described, the piston and cylinder of the gas spring device are coupled by a multi-sheave block and tackle system conferring a mechanical advantage, thereby enabling forces tending to lengthen the strut to be overcome by the application of manual effort to the block and tackle system.

Whilst the valve releasable, variable length, pressurized gas spring strut employs a block and tackle system essentially similar to that employed in the earlier described valveless pressurized gas spring strut, the valve releasable, variable length, pressurized gas spring strut, of the present invention, is self-sustaining in length, the block and tackle system associated with the strut being employed in the determination of the length of the strut, both in elongation and in contraction, but, the strut length having been so determined, playing no part in the maintenance of the length to which the strut shall have been set.

As regards the prior art vang employing the hydraulic strut referred to previously, that vang is costly by comparison with the strut system of the present invention and, moreover, is relatively sluggish in operation, a matter of concern where speed of operation is a matter of paramount importance.

It should be understood, further, that it is a virtue of all strut type vangs, whether hydraulic or involving the use of gas pressurized spring devices, that, in distinction from the basic kicking strap, a topping lift is no longer required, the vang being, in operation, rigid strut.

According to the present invention, a vang comprises:

(A) a valve releasable, variable length, pressurized gas spring strut;

(B) a control valve actuation control mechanism having:

(i) a main body part integral with one of the relatively movable parts, piston or cylinder, of the gas pressurized spring device of said strut;

(ii) valve actuator member operating means having (a) a first part carried by said main body part and displaceable with respect thereto, being a part displacement of which is constrained such as, in the course of such displacement, to act upon the actuator member of the control valve of the pressurized gas spring device;

(b) a second part held captive with limited permitted displacement with respect to said main body part, the arrangement being such that in the course of displacement of said second part with respect to said main body part, said first part is caused to be displaced by said second part, the first part then acting upon said valve actuator member; and, (c) spring preload means serving to bias said second part such that the first part is normally at a position with respect to said body part at which the first part is unable to exert action on said control valve actuator member, the spring preload being such as to permit movement of said operating means with respect to said main body part only in response to a force in excess of a certain magnitude;

(C) means adapted to facilitate the coupling at one end of the valve releasable pressurized gas spring strut to the main-boom of a sailing vessel; and, (D) means adapted to facilitate the coupling at the other end of the valve releasable pressurized gas spring strut to a part of the vessel fixed with respect to said main-boom.

Preferably, the vang incorporates means operative such as to enable said control valve to be set, on demand, to the open state independently of said control valve actuation control mechanism.

Preferably also, the vang incorporates manually operable means adapted, arranged, and constructed such that, when the vang is installed on a vessel and said strut is actuated such that the main-boom is constrained to extend in a direction perpendicular to the longitudinal direction of the mainmast, said manually operable means is at a position at which it is operable to prevent extension of the strut and consequent angular displacement of the main-boom away from its perpendicular relationship with the main-mast.

DESCRIPTION OF PREFERRED EMBODIMENTS OF THE INVENTION

Figure 1:
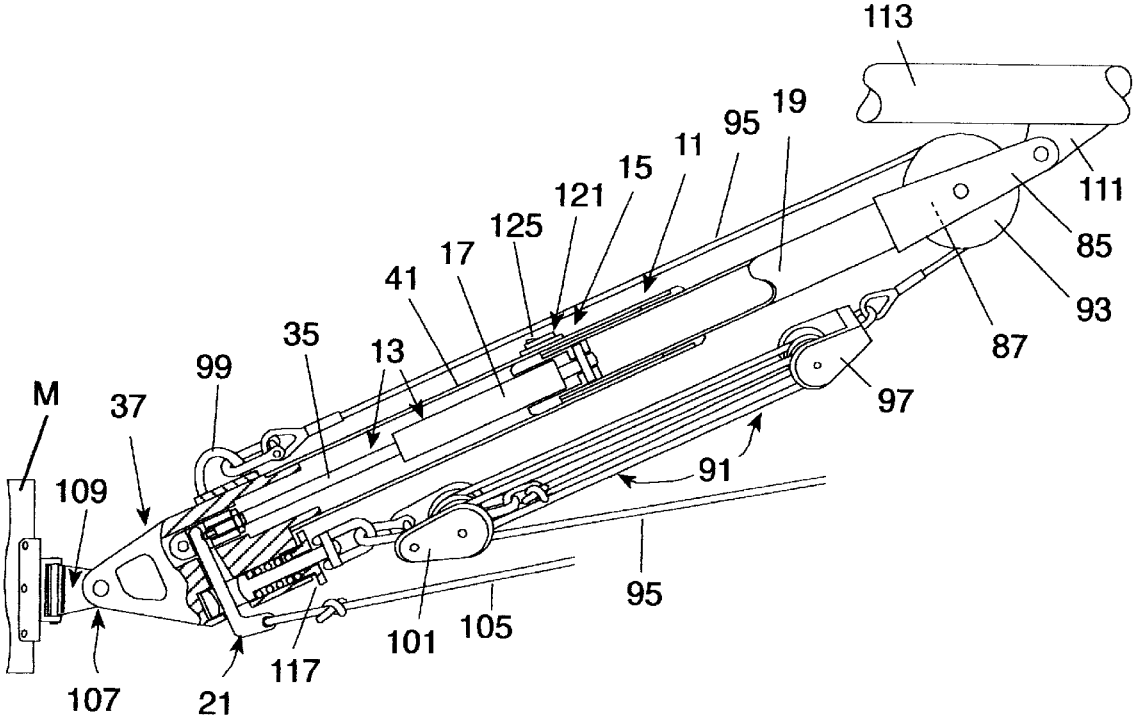
FIG. 1 is a diagram showing, in part section, a vang, in accordance with the invention, and its connections to the main-boom and main-mast of a yacht.
Figure 2:
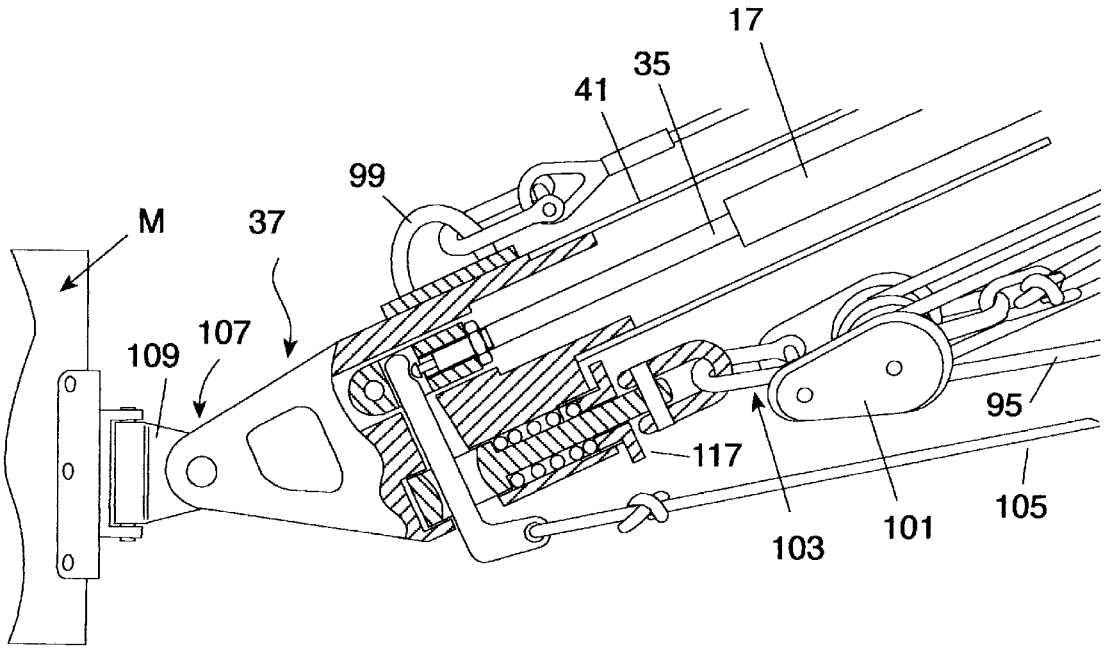
FIG. 2 is a scrap diagram showing, on an enlarged scale, one portion of the vang depicted in FIG. 1.

The vang comprises a valve releasable, variable length, pressurized gas spring strut 11, being a strut incorporating a hydro-pneumatic piston and cylinder arrangement 13, the cylinder 15 of which, for the purposes of this example of a construction of vang in accordance with the invention, comprises the basic cylinder part 17 of the pressurized gas spring device 13, holding a charge of nitrogen under a high pressure, and a cylindrical extension part 19; and a control valve actuation control mechanism 21 for a control valve (not shown) of the hydro-pneumatic piston and cylinder arrangement 13.

The basic cylinder 17 has, at one end, an axially projecting spigot 25 pierced through, diametrically, by a passage 27. The spigot carrying end portion of the basic cylinder 17 is received within a generally cylindrical body 29 having a stepped outer cylindrical surface, and a cross-pin 31, extending through the passage 27 into aligned diametrically opposed bores in the wall of the body 29, serves to couple the basic cylinder 17 to the cylindrical body 29. The cylindrical extension part 19 has a wall thickness substantially equal to the height of the circumferentially extensive step of the cylindrical body 29, said step providing an abutment for the end of the extension part 19, there being an interference fit between the extension part 19 and the cylindrical body 29.

The free end of the piston rod 35 of the piston (not shown) of the piston and cylinder arrangement 15 is held secure in the main body part 37 of the control valve actuation control mechanism 21. The main body part 37 has an integral cylindrical sleeve 41, within the free end portion of which the united cylindrical body 29 and cylindrical extension part 19 have a sliding fit. An annular end cap 43 provides a sliding seal for the annular clearance space between the sleeve 39 and the cylindrical extension part 19.

In the example shown in FIG. 1, the main body part 37 of the control valve actuation control mechanism 21 is formed with a passage 45 having first and second end walls 47*a*, 47*b*, respectively, the end wall 47*b* being constituted by a threaded plug 49 having an axial passage 51 and being screwed into a threaded end portion of the passage 45.

A plunger 53 having a head portion 55 and a stem portion 57 extends into the passage 45, the plunger head 55 being located wholly within the passage and the plunger stem portion 57 projecting from the main body part 37 through mouth of the passage 51 of the plug 49.

Within the passage 45, surrounding the plunger stem portion 57 there is an helical spring 59 which is held under compression by and between the passage end wall 47*b* and an abutment surface being constituted, in the example, by the back surface of the plunger head portion 55. The helical spring 59 thereby exerts a spring pre-load, urging the plunger head 51 to contact with the other end wall 47*a* of the passage 45.

The main body part 37 has, in addition to the plunger receiving passage 45, a passage 61 extending in its direction of length parallel to and a passage 63 extending in its direction of length transversely to the passage 45, the passages 45 and 61 communicating with one another by way of the passage 63. The plunger head portion 55 has, furthermore, a transverse passage 65 thereacross communicating at both ends with the transverse passage 63 of the main body part 37.

Considering the connection of the piston rod 35 to the main body part 37 in greater detail, it will be seen that the end portion of the piston rod is screwed into a threaded bore formed in a block 67 formed with a transverse passage 69, the block being held secure within the main body part passage 61. A lock nut 71 inhibits any tendency for the piston rod to become loose on or to become detached from the main body part 37.

A lever 73, constituting the control valve actuator displacement means, extends through the passage 63 of the main body part and the transverse passage 65 of the plunger head portion 55 and has the end 75 thereof remote from outer lever end 77 trapped within the passage 69 of the block 67. The inner lever end portion has a concavity 79 the wall of which, with the lever 73 at its rest or inactive state, is clear of or lightly resting on the end of the actuator pin 81 of the piston and cylinder control valve, the valve actuator pin 81 being, as shown, at the end of the piston rod 35. The lever 73 has a width substantially less than that of the plunger head passage 65 through which the lever extends.

At the free end of the cylindrical extension 19 to the basic cylinder 17, there is a forked end-piece 85 having a slot 87 therethrough.

Ancillary to the strut 11, there is provided manual actuation means comprising a multi-sheave block and tackle system 91, providing, in the example, a 4:1 mechanical advantage, and, within the slot 87 of the end-piece 85, an idler pulley 93 rotatable about an axle or spindle extending between the side walls of the slot 87. The block and tackle system 91 is connected by the sheet 95, which extends from one 97 of its pulley blocks, by way of the pulley 93, to an eye member 99 secured to the main body part 47. The other pulley block 101 is connected by a shackle 103 to the plunger stem portion 57.

Secured to the outer end of the lever 73, there is a line 105.

The main body part 47 has a tang portion constituting one principal part of a universal joint 107, the other principal part 109 of which is secured to the main-mast M; and the forked end-piece 85 at the outer extremity of the cylindrical extension, is pivotally connected to a lug 111 projecting from the main-boom 113.

In operation, a demand, being a load in excess of the pre-load of the spring 59, applied to the sheet 95 of the block and tackle system 91 produces an amplified force at the plunger 53, the block and tackle system, at the same time, shortening in length. The action of the plunger 53 upon the lever 73, as a result of movement of said plunger against the spring pre-load, causes the lever 73 to rock and, in rocking, to act upon the control valve actuator pin 81. The opening of the control valve consequent upon the depression of the actuator pin frees the strut for expansion or for contraction. In expansion of the strut, the block and tackle system 91, whilst being maintained under a tension calculated to overcome the spring preload, and, hence, to hold the actuator pin 81 depressed, is allowed to lengthen progressively until, the strut having attained the desired overall length, as indicated by the shape of the main-sail, the demand force is removed from the sheet 115 of the block and tackle system.

Operation of the vang, in compression, is essentially the same as for expansion, the only difference involved being that, for compression, demand force applied to the block and tackle system 91 is maintained at a value suitably great to compress the piston and cylinder of the strut 11 to the desired length against the reaction due to the pressurized gas within. Such a demand is, of course, very much greater than the force necessary to overcome the spring pre-load on the plunger 53. In either case, immediately upon relaxation of tension in the block and tackle sheet 95 to which the demand force is applied, the plunger 53 is restored, under the action of the spring pre-load, to its rest position, the lever 73 being thereby rocked away from the actuator pin 81 which, under its own spring bias, returns to its rest position, also, the control valve closing and the strut 11 becoming, in consequence, locked at the new desired overall length.

It is sometimes necessary to dump the driving force acting on the main-sail. It is for this purpose that the lever 73 is undersized in relation to the width of the passage 65 through the plunger head portion 55, thereby to permit lost motion therebetween. The application of a quite small force applied to the release line 105, causes the lever 73 to be rocked rapidly such as, by immediate consequential opening of the control valve to cause the strut 11 to expand without constraint to its maximum length, the main-boom 113 swinging upwardly, the main-sail being thereby freed from tension from the vang and losing its aerodynamic contour.

In the example, the pre-load of the spring 59 is made adjustable, the plunger stem portion 57 being threaded along at least the end portion thereof remote from the plunger head portion 55 and carrying a knurled nut 117.

Reaction of the main body part 37 to the screw action of the knurled nut 117 along the spindle 37 causes an outwards displacement of the spindle 37 resulting in a change in the compressive load on the spring 59.

The vang depicted in FIG. 1 has the block 101 of the block and tackle system 91 connected to the plunger stem portion 57 and the block 97 connected to the eyelet 99 projecting from the main body part 37 by way of the idler pulley 93. The multi-sheave block and tackle system 91 may be described as a lengthwise-extensive girdle around the valve releasable, variable length, pressurized gas spring strut. Tension in the block and tackle system is effective to control the strut in length.

Figure 5:
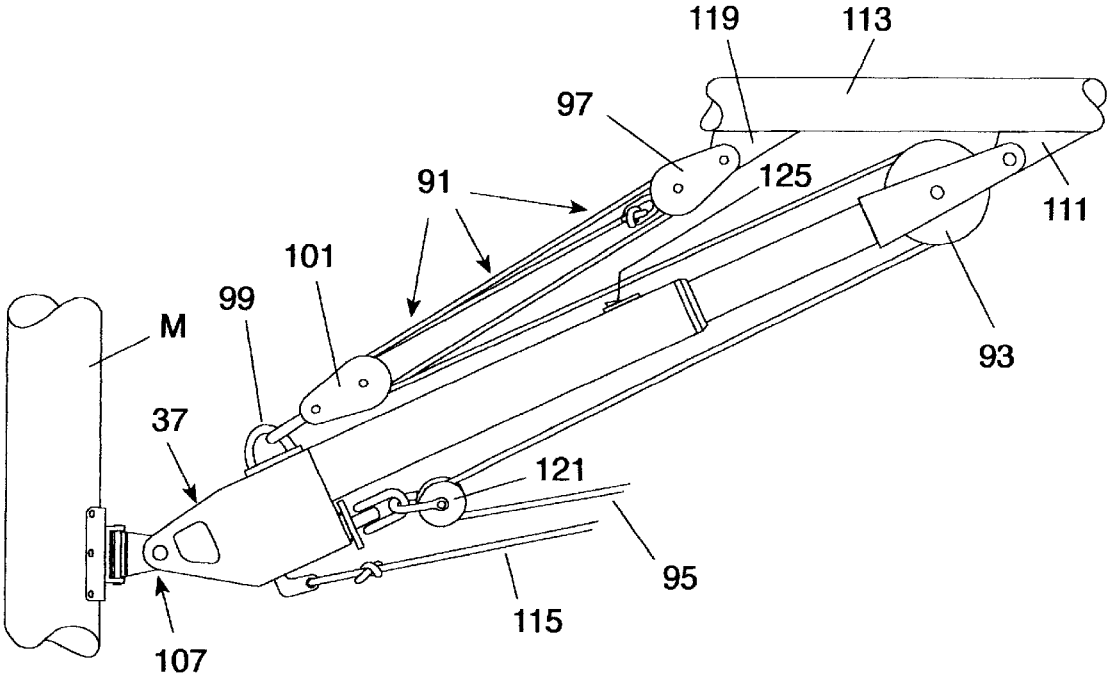

In the arrangement of FIG. 5, the main-boom 113 is fitted with a lug 119 to which the block 93 of the block and tackle 89 is pivotally attached, the other block 101 of the block and tackle system being connected to the eyelet 99 and the sheet 95, to which force is to be manually applied, being connected to the stem portion 57 of the plunger 53 by way of the idler pulley 93 and the shackle arrangement 103 to the stem portion 57 of the plunger 53.

The arrangement of FIG. 5 has the advantage that, action and reaction between the main-boom 113 and the block and tackle system 91 under a load applied at the sheet 95 gives rise to enhanced friction between the sheet 95 and the sheaves of the blocks 93, 103.

In distinction from the arrangement of FIG. 1, when the valve releasable, variable length, pressurized gas spring strut, having been set to the desired length, under the action of the block and tackle system, upon removal of the applied load, the plunger 53 is able immediately to respond, the lever 73 being rocked away such as to permit the control valve actuator pin 81 to be restored to its rest position under the spring bias acting thereon.

In the arrangement of FIG. 1, similar friction levels developed in the block and tackle arrangement 91 in response to a load applied to the sheet 95, have a decay time of, perhaps, two or three seconds, a delay which might not be acceptable, particularly under racing conditions. On the other hand the block and tackle system 91 of FIG. 1 is less vulnerable to damage and does not call for the provision of the additional lug 119.

For the sake of completeness, it should be mentioned that, in a working design for a vang in accordance with the invention, a valve releasable, gas pressurized, variable length strut having a stroke length of 300 mm and producing a force of 800 Newtons was employed, and the helical spring 59 had a spring rate of 150 Newtons, at compression to 25% of its uncompressed length.

For an introduction to Vangs and their use, the reader is referred to the work entitled "Sail Power", by Wallace Ross, second edition, published by Adlard Coles Limited, 1985.

The foregoing description has addressed the subject of vangs incorporating, as an essential element of the vang, a valve releasable, variable length, pressurized gas spring strut; and the description has, accordingly, been directed substantially exclusively to the operation of the strut and other essential elements in their cooperation in the operation of the whole in its primary function as a vang.

The combination of elements, including, as it does, a strut as aforestated, may be configured such as to provide, as an additional facility, means for use in reefing the main-sail.

The current common practice for main-sail reefing is to employ in-mast reefing. In the practice of in-mast reefing, the main-sail is wound in at the luff of the sail, to be stored, furled or part-furled, within the hollow cylindrical main-mast.

In-mast reefing has certain disadvantages. Firstly, the main-mast, being, in length, about three times that of the main-boom, the displacement between the centre of pressure of wind on the sail and the fore and aft line through the centre of buoyancy of the vessel is always relatively large, and the moment of the resultant wind force on currently exposed sail area about the fore and aft axis through the centre of buoyancy of the vessel is correspondingly great. This, constituting, as it does, a threat to the stability of the vessel is a codition to be avoided, if possible.

In order to reduce the exposed sail area to a value such that the moment of the resultant wind force about said fore-and-aft axis, hard reefing of the sail is called for, the resultant wind force on the shortened sail and the moment of such resultant force about said fore-and-aft axis being correspondingly reduced as a result.

Secondly, in order to give better aerodynamic shape to the main-sail, it is common practice to incorporate into the main-sail stiffener elements, so-called battens, being elongate members composed, conventionally, of epoxy-bonded fibre glass, such battens being held within elongate pockets spaced apart one above another to extend from the leech towards the luff of the sail. As will be apparent, sails incorporating stiffener battens cannot be stored, furled, within the main-mast and, accordingly, in order to shorten main-sails incorporating battens as aforesaid, the sail is simply lowered. In-Mast reefing (without battened main-sails, of course) is practiced with Cruising yachts, where performance is not at a premium. In the case of Racing yachts, the battened main-sail is shortened by simply lowering the sail, as mentioned.

The vang in accordance with the invention may be provided with a facility for reefing the main-sail. In distinction from the above described In-Mast reefing facility, the facility which may be offered using the vang of the present invention involves In-Boom reefing, the sail, whether or not stiffened with battens, being stored, furled or part-furled, on a rotatable mandrel extending, lengthwise, within the hollow main-boom.

The practice of In-Boom reefing is not new. It has however, been beset by the problem that, in order to furl the sail in this manner, it is necessary that the boom be accurately set perpendicular to the main-mast. Failure to set and hold the boom at such angle, renders efforts to wind the sail onto the mandrel a matter of great difficulty, to say the least, particularly where, as is commonly the case, the furling operation is to be conducted under high wind conditions.

Figure 3:
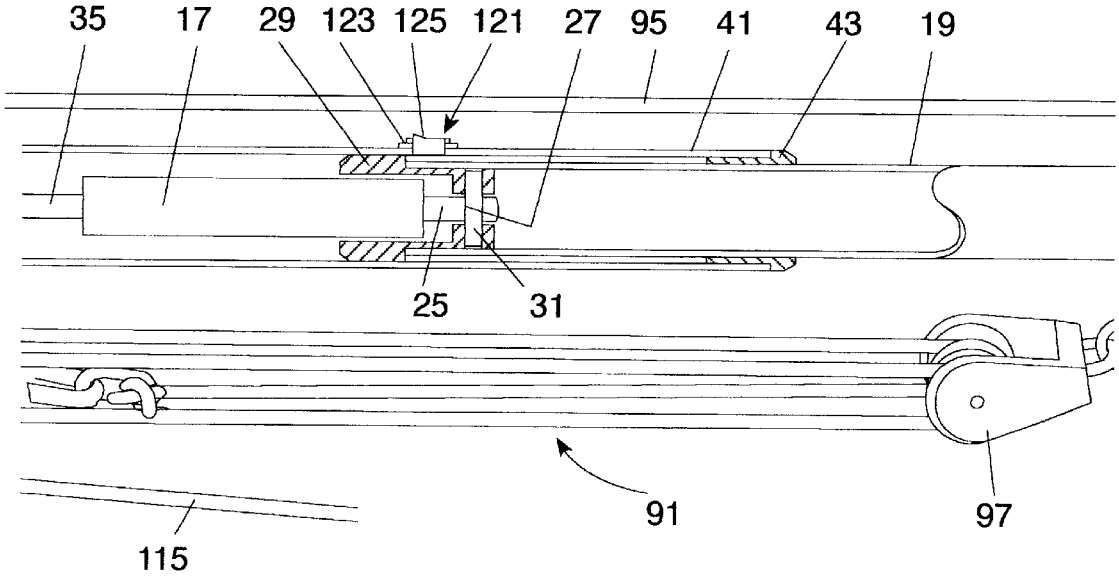
FIG. 3 is a diagram showing, on an enlarged scale, another portion of the vang depicted in FIG. 1.
Figure 4:
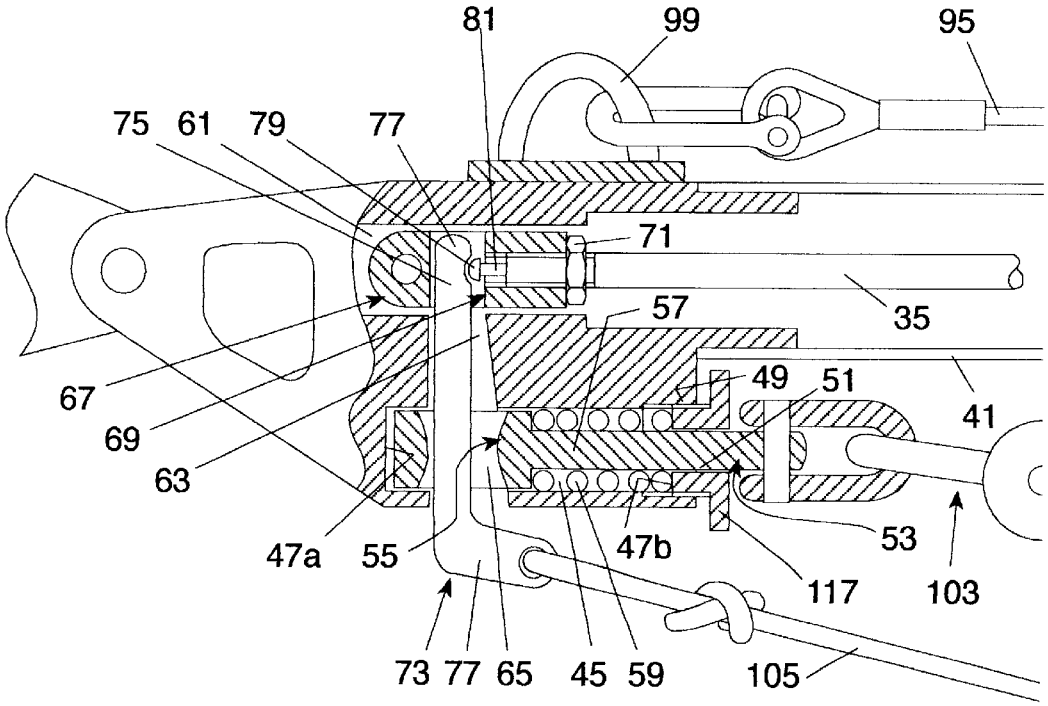
FIG. 4 is a scrap diagram showing, on a still further enlarged scale, a portion of scrap diagram of FIG. 2; and, FIG. 5 is a diagram showing an alternative arrangement for the vang to that shown in FIG. 1.

As may be seen, in FIGS. 1 and 3, when the main-boom 113 is perpendicular to the main-mast M, the cylindrical body 29 is at the position shown in the Figure.

Figure 6:
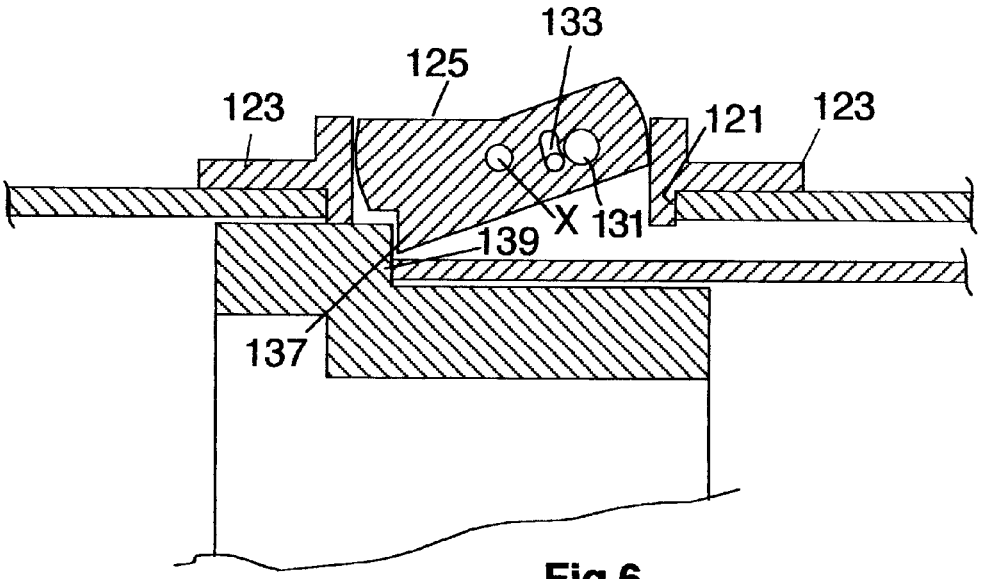
FIG. 6 is a diagram showing the vang of FIG. 1 but modified to incorporate a device for assisting in the use of the vang for the additional purpose of In-Boom reefing of the main-sail the device being shown in the operative position; and, FIG. 7 is a diagram corresponding to FIG. 6, but with the device shown in the inoperative position.
Figure 7:
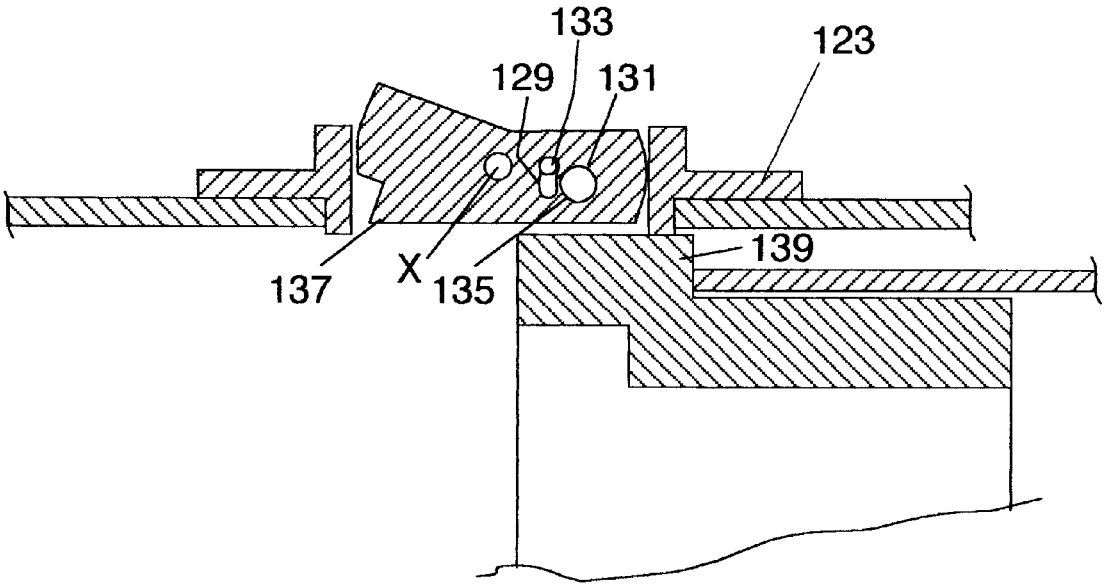

Referring to FIGS. 6 and 7, which illustrate a modification to the vang of FIG. 1, the cylindrical sleeve 41 has an elongate opening 121 within which is secured a correspondingly elongate collar member 123 within which is located a rocker element 125, the latter element being connected pivotally connected at opposite side walls of the collar member 127 for rocking movement about a pivot axis X in the sleeve 41.

The rocker element 125 has a arcuate slot 127 therethrough, the hole 127 having its centre coincident with the axis X. Adjacent to the slot 127, at the convex side thereof, there is a further aperture 129. A pin 131 projects from one of the aforesaid side walls of the elongate opening 121 into the arcuate slot 127. The collar member 123 is of a plastic material, and the wall 133 between the arcuate slot 127 and the aperture 129 has a thickness such that, when the rocker element 125 is rocked clockwise, compliance in the wall 133 enables the pin 131 to pass from one end of the arcuate slot 127 to the other.

The rocker element 125 has at its leading edge, a downwards projection 135 which, in one extreme position of the rocker element 125, is or is not in the path of movement of the cylindrically extensive step 137 of the cylindrical body 29 forming part of the cylinder assembly of the strut 11, accordingly as the at one or the other of its extreme positions as determined by the position of the pin 131 within the slot 127.

The position of the elongate opening 121 along the cylindrical sleeve 41 is such that when the boom 113 is at an angle making not less than a right angle with the main-mast A, the elongate opening 121 is at a position relative to the cylindrical body 29 such that the rocker element 125 may be rocked from the position depicted in FIG. 7 to the position depicted in FIG. 6.

With the downwards projection 135 of the rocker element 125 in contact with the circumferential step 137 of cylindrical body 29, the boom 113 is accurately at right angles to the main-mast M, the position at which the main-sail may be wound onto the mandrel within the boom from the foot of the sail, with battens where fitted, and without any run-off tendency.

The important in-boom reefing facility provided by the modification shown in FIGS. 6 and 7, stems from the functional nature of the valve releasible, variable length, pressurized gas spring strut employed in the vang. Since, as previously indicated, the strut is self-sustaining in length, once the actuating valve of the strut is returned to its inoperative state, the provision of the rocker element 125 might be thought to be a redundancy.

The angular accuracy to which the boom must be set and maintained, preparatory to in-boom furling of the main-sail, is, however, more readily accomplished by the use of the rocker element effectively as a gauge in determining the boom setting. With the boom set and the actuating valve of the strut restored to the inoperative state, the rocker element 125 may be rocked to the inoperative position shown in FIG. 7, the angular position of the boom with respect to the mast continuing to be held under the self-sustaining action of the strut 11.

In practice, the boom 113 is constrained such that it tilts with a generally slightly downwards tilt from its connection with the main-mast M or generally perpendicular thereto, perhaps. It is unnecessary that the rocker element 125 shall provide for upwards tilt of the boom.

We claim:

1. A vang which comprises:

(A) a valve releasable, variable length, pressurized gas spring strut;

(B) a control valve actuation control mechanism having:

(i) a main body part integral with one of the relatively movable parts, piston or cylinder, of the gas pressurized spring device of said strut;

(ii) valve actuator member operating means having (a) a first part carried by said main body part and displaceable with respect thereto, being a part displacement of which is constrained such as, in the course of such displacement, to act upon the actuator member of the control valve of the pressurized gas spring device;

(b) a second part held captive with limited permitted displacement with respect to said main body part, the arrangement being such that in the course of displacement of said second part with respect to said main body part, said first part is caused to be displaced by said second part, the first part then acting upon said valve actuator member; and, (c) spring preload means serving to bias said second part such that the first part is normally at a position with respect to said body part at which the first part is unable to exert action on said control valve actuator member, the spring preload being such as to permit movement of said operating means with respect to said main body part only in response to a force in excess of a certain magnitude;

(C) means adapted to facilitate the coupling at one end of the valve releasable pressurized gas spring strut to the main-boom of a sailing vessel; and, (D) means adapted to facilitate the coupling at the other end of the valve releasable pressurized gas spring strut to a part of the vessel fixed with respect to said main-boom.

2. A vang as claimed in claim 1 which comprises: a pulley block and tackle system connected to and between said second part of said valve member operating means and said main body part of said control valve actuation control mechanism by way of a running connection with the other relatively movable part of said control valve actuation control mechanism, the mechanism part, that is to say, with which said main body part is not integral.

3. A vang as claimed in claim 2 having;

a main body part formed with a passage having first and second end walls, at least one of said end walls having an aperture therethrough;

extending into said passage, a plunger having a head portion and a stem portion, said head portion being located wholly within said passage and said stem portion projecting from said main body part through said aperture in said one end wall; • within said passage, surrounding said stem portion, an helical spring held under compression by and between the passage end wall through the aperture of which said stem portion projects and an abutment surface spaced from said end wall along said plunger, the helical spring thereby exerting a spring pre-load, being the aforementioned spring pre-load, urging the plunger head portion to contact with the other end wall; and, • said control valve actuator displacement means comprises a member movable by said plunger head portion, upon the application to the stem of said plunger, of a force of a magnitude to overcome the spring pre-load acting on the plunger.

4. A vang as claimed in claim 2 and which incorporates means operative such as to enable the control valve to be set, on demand, to the open state independently of said control valve actuation control mechanism.

5. A vang as claimed in claim 2 or 3 and which incorporates means operative such as to enable the control valve to be set, on demand, to the open state independently of said control valve actuation control mechanism.

6. An apparatus as claimed in claim 5 in which said main body part has a second passage therein, being a passage extending in a direction generally transversely of the direction of the plunger receiving passage and having an intersection therewith; the plunger head has a transverse passage therethrough which communicates at each end with the portions of said second passage to either side of the plunger receiving passage; a lever extends though said communicating passages such as to project from said main body part at one end of said second passage, and is pivoted at the other end thereof at a position such that it is in contact with said control valve actuator at a position close to said other lever end, said lever being such, in relation to the cross-sectional size and shape of said communicating passages, that, whilst being in contact, at a position intermediate the ends thereof, with a surface portion of the boundary wall of the aperture through said plunger head portion, lost motion between the lever and the plunger head portion, permits angular movement of the lever about its pivot position by deflection of the lever from said projecting end thereof.

7. A vang as claimed in claim 1 and which incorporates manually operable means adapted, arranged, and constructed such that, when the vang is installed on a vessel and said strut is actuated such that the main-boom is constrained to extend in a direction perpendicular to the longitudinal direction of the main mast, said manually operable means is at a position at which it is operable to prevent extension of the strut and consequent angular displacement of the main-boom away from its perpendicular relationship with the main-mast.

8. A vang as claimed in claim 7 and which incorporates manually operable means adapted, arranged, and constructed such that, when the vang is installed on a vessel and said strut is actuated such that the main-boom is constrained to extend in a direction perpendicular to the longitudinal direction of the main mast, said manually operable means is at a position at which it is operable to prevent extension of the strut and consequent angular displacement of the main-boom away from its perpendicular relationship with the main-mast.

* * * * *